United States Patent [19]

Raetzsch et al.

[11] 4,209,380

[45] Jun. 24, 1980

[54] CATHODE ELEMENT FOR ELECTROLYTIC CELL

[75] Inventors: Carl W. Raetzsch; Hugh Cunningham, both of Corpus Christi, Tex.

[73] Assignee: PPG Industries, Inc., Pittsburgh, Pa.

[21] Appl. No.: 928,647

[22] Filed: Jul. 27, 1978

[51] Int. Cl.[2] ..... C25B 11/03; C25B 13/08; C25B 9/00

[52] U.S. Cl. ..... 204/282; 204/283; 204/258

[58] Field of Search ..... 204/282, 283, 271, 258

[56] References Cited

U.S. PATENT DOCUMENTS

| | | | |
|---|---|---|---|
| 1,153,438 | 9/1915 | Norquist | 204/282 X |
| 3,344,053 | 9/1967 | Neipert et al. | 204/283 X |
| 3,878,082 | 4/1975 | Gokhale | 204/282 X |
| 4,073,715 | 2/1978 | DeNora et al. | 204/283 X |

*Primary Examiner*—John H. Mack
*Assistant Examiner*—D. R. Valentine
*Attorney, Agent, or Firm*—Richard M. Goldman

[57] ABSTRACT

Disclosed is a cathodic element for a chlor-alkali electrolytic cell. The cathodic element has a hollow electrolyte permeable nonconductive finger with a permionic membrane on the outer surface of the finger and a cathodic electrode inside the finger, spaced from and substantially parallel to the walls of the finger.

13 Claims, 5 Drawing Figures

CATHODE ELEMENT FOR ELECTROLYTIC CELL

DESCRIPTION OF THE INVENTION

In chlor-alkali electrolysis, for example, the electrolysis of potassium chloride brines or sodium chloride brines to produce chlorine and the corresponding alkali metal hydroxide as caustic potash or caustic soda, an electrolytic cell having the anode separated from the cathode by a suitable separator may be utilized. Such a cell, referred to as a permionic membrane cell or a diaphragm cell, has an acidified, chlorinated brine solution saturated in chlorine as the anolyte. The anolyte liquor contains from about 175 to about 250 grams per liter sodium chloride or from about 220 to about 320 grams per liter potassium chloride and is at a pH of from about 1.5 to about 5.5

The catholyte liquor, also referred to as the cell liquor, is an alkaline solution of the alkali metal hydroxide, e.g., potassium hydroxide or sodium hydroxide. In a permionic membrane cell, the catholyte liquor or cell liquor is substantially chloride free and contains from about 10 to about 50 weight percent alkali metal hydroxide; while in a diaphragm cell, the catholyte liquor contains from about 15 to about 25 weight percent sodium chloride or from about 19 to about 35 weight percent potassium chloride.

In the cells herein contemplated, the anolyte is separated from the catholyte by a separator. The separator may be an asbestos diaphragm, that is, a separator of fibrous and particulate asbestos deposited from a cell liquor slurry. Such a diaphragm is electrolyte permeable and provides a catholyte containing sodium chloride and sodium hydroxide or, in the electrolysis of potassium chloride, potassium chloride and potassium hydroxide.

For various reasons, it is desirable to provide a synthetic separator rather than an asbestos separator. The synthetic separators, typically fabricated of polymeric materials, may either be microporous diaphragms or permionic membranes. Microporous diaphragms are electrolyte permeable providing a catholyte liquor containing from about 15 to about 25 weight percent sodium chloride and from about 10 to about 15 weight percent sodium hydroxide in the electrolysis of sodium chloride or from about 19 to about 35 weight percent potassium chloride and from about 13 to about 20 weight percent potassium hydroxide in the electrolysis of potassium chloride.

Permionic membranes, as distinguished from microporous diaphragms, have acid groups on the polymer to provide cation selectivity. That is, the permionic membrane is permeable to cations and impermeable to anions so that, in permionic membrane cells, the catholyte is typically chloride free, containing from 10 to about 50 weight percent alkali metal hydroxide, less than about 1 percent and preferably less than about 0.1 weight percent potassium chloride or sodium chloride.

The synthetic separators useful in electrolytic cells for the electrolysis of alkali metal chlorides are exemplified by halogenated polymeric materials. The halogenated polymeric materials include halocarbon polymers such as fluorocarbons, chlorofluorocarbons, hydrocarbon fluorocarbon polymers, and hydrocarbon chlorofluorocarbon copolymers. By fluorocarbons are meant polymers containing either as homopolymers, copolymers, or terpolymers or polymers having even more moieties, perfluorinated moieties such as perfluoroethylene, hexafluoropropylene, and perfluoro alkyl vinyl ethers. Chlorofluorocarbons include chlorotrifluoroethylene copolymers and terpolymers thereof, for example, with perfluoroethylene, hexafluoropropylene, and perfluoro alkyl vinyl ether. Hydrocarbon fluorocarbons include vinyl fluoride, vinylidene fluoride, copolymers of vinyl fluoride, vinylidene fluoride, perfluoroethylene, and hexafluoropropylene with ethylene, copolymers of vinyl fluoride and vinylidene fluoride with each other or with tetrafluoroethylene, hexafluoropropylene, and vinyl alkyl ethers. Hydrocarbon-chlorofluorocarbons include copolymers of vinyl fluoride, vinylidene fluoride, ethylene, vinyl chloride, vinylidene chloride with chlorotrifluoroethylene as well as copolymers of vinyl chloride and vinylidene chloride with perfluoroethylene, hexafluoropropylene, vinyl fluoride, vinylidene fluoride, and perfluoro alkyl vinyl ethers.

Where the synthetic separator is a microporous diaphragm, the polymer may be substantially free of active acid groups. However, where the synthetic separator is a permionic membrane, the halocarbon polymers have cation selective groups thereon, as exemplified by acid groups. Typical acid groups include sulfonyl groups and their derivatives such as sulfonamides and sulfonic acid groups, carboxylic acid groups and their derivatives such as esters, phosphonic acid groups, and phosphoric acid groups. Most commonly, where the synthetic separator is a permionic membrane, the polymer is a perfluorinated polymer and the acid group is either a sulfonic acid group or a carboxylic acid group.

It has been reported that superior results are obtained in the electrolysis of alkali metal chlorides in electrolytic cells having synthetic separators if the synthetic separator is spaced from the active cathodic electrode. However, synthetic separators, that is, sheets of synthetic polymeric material, must be sealed in order to provide separators is shapes useful in electrolytic cells having fingered electrodes. Sealing involves the use of heat, strongly acidic solutions, and strongly alkaline solutions. These combinations are deleterious to the anode if any element of the sealing process is carried out after the synthetic separator is mounted on the anode. Similarly, such sealing methods are deleterious to the cathode if a significant portion of the sealing is done after the synthetic separator is mounted on the cathode.

It has now been found that a particularly desirable electrode configuration can be provided having the synthetic separator spaced from the cathode. The electrode is characterized by a hollow, substantially nonconductive finger with a synthetic separator on the outer surface thereof and a cathodic electrode within the hollow, substantially nonconductive finger. Such a cathode unit may be utilized in either a monopolar cell or a bipolar cell.

THE FIGURES

DETAILED DESCRIPTION OF THE INVENTION

Figure 1:
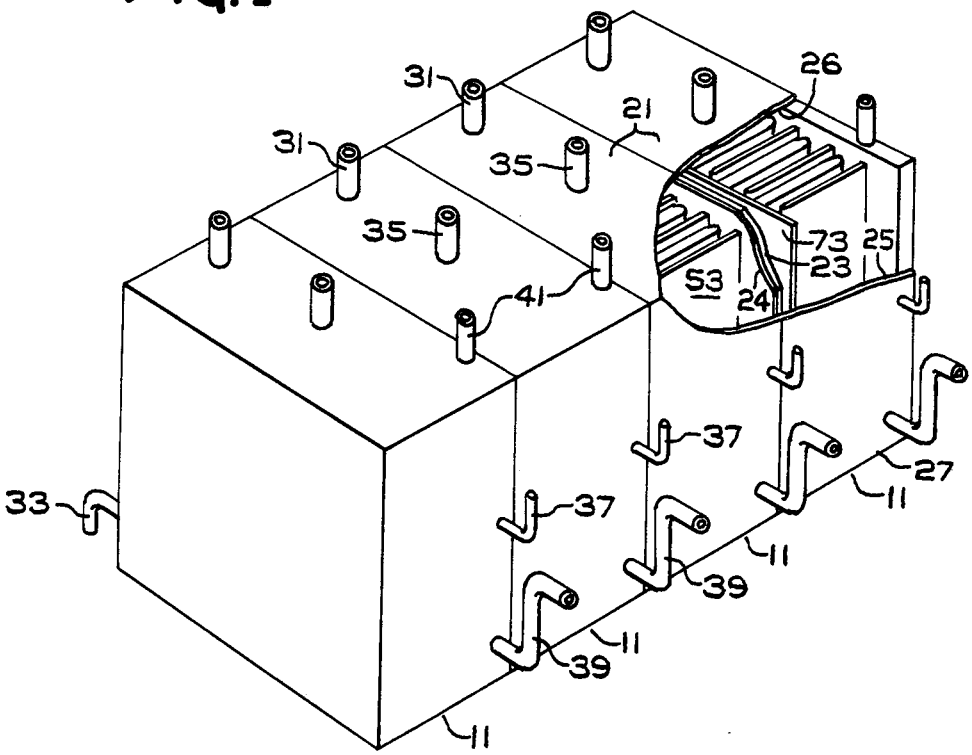
FIG. 1 is an isometric view in partial cutaway of a bipolar electrolyzer.

The relationship of the cathode structure of the invention to an electrolytic cell, for example, an electrolytic cell of a bipolar electrolyzer, is shown in FIG. 1.

The bipolar electrolyzer 1 has a plurality of individual electrolytic cells 11, e.g., from 2 to 100 or more. Each cell 11 includes an anodic unit 51 of one bipolar unit 21 and a cathodic unit 71 of an adjacent bipolar unit 21.

Each cell has an anodic side 51 with a brine feed 31, brine recovery means 33 (not shown), and a chlorine outlet 35. The cell further has an anolyte-resistant sheet 24 on the backplate 23 of the bipolar unit 21 and an anolyte-resistant lining 28 on the cell walls 25, 26, and 27 of the bipolar unit 21. Extending outwardly from the anolyte-resistant sheet 24 of the backplate 23 within the bipolar unit 21 are the anode blades 53.

The cathodic side 71 of the electrolytic cell 11 has water feed means 37, cell liquor recovery means 39, hydrogen recovery means 41, a cathode element 81, and a back screen 73. The back screen 73 is spaced from the backplate 23.

Figure 2:
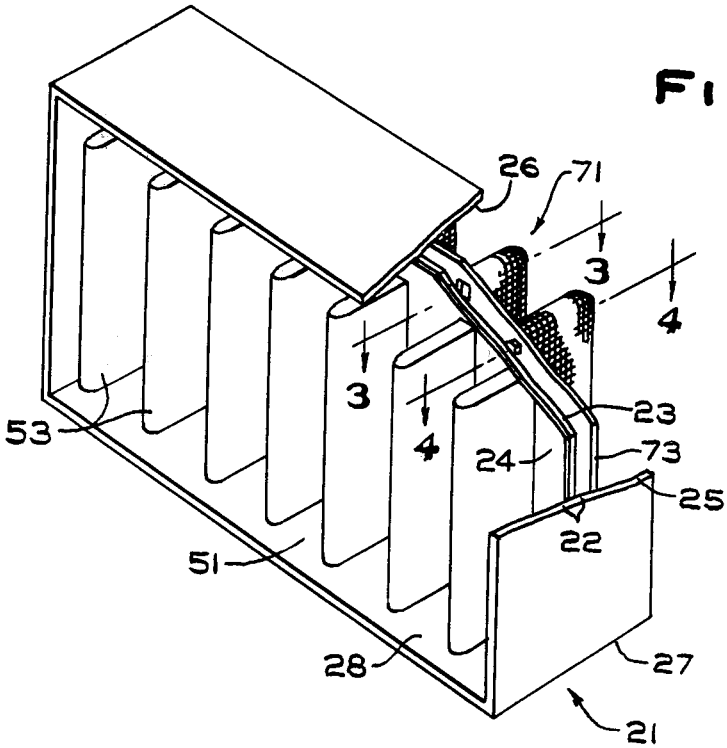
FIG. 2 is an isometric view in partial cutaway of a bipolar element, i.e., a bipolar electrode.
Figure 3:
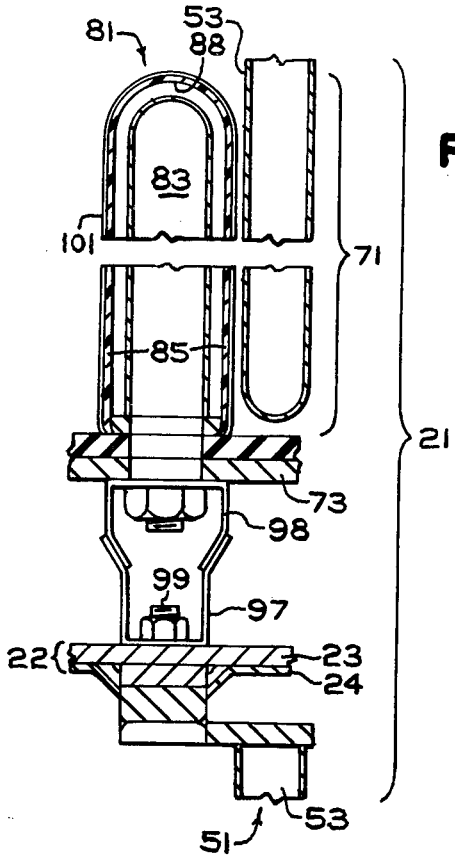
FIG. 3 is a cutaway view of a bipolar element of FIG. 2 along cutting plane 3'—3'.
Figure 4:
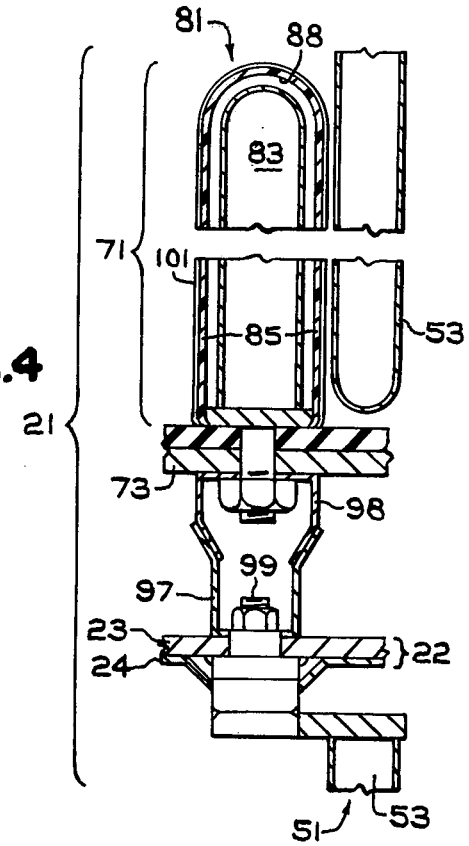
FIG. 4 is a cutaway view of a bipolar element of FIG. 2 along cutting plane 4'—4'.
Figure 5:
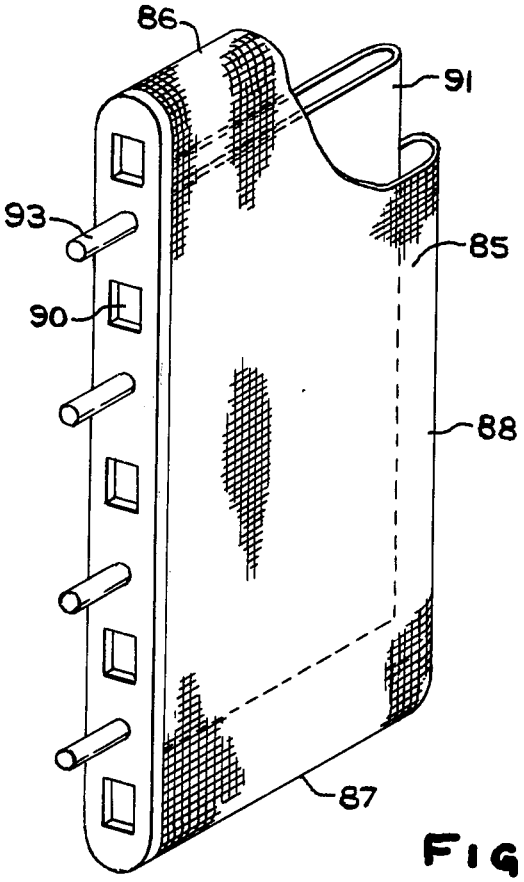
FIG. 5 is an isometric view in partial cutaway of a cathode element.

The basic structural element in the bipolar unit 21, shown generally in FIG. 1 and in especial detail in FIG. 2 as well as in FIGS. 3 and 4, is the bipolar backplate 22. The backplate 22 separates the anodic side 51 of the bipolar unit 21 from the cathodic side 71 of the bipolar unit 21.

The backplate 22 has two members, a heavy, catholyte-resistant plate 23 and a thin, anolyte-resistant sheet 24. Furthermore, a thin, anolyte-resistant sheathing, layer, lining, or sheet 28 lines the inside of the top 26, bottom 27, and walls 25 of the bipolar unit 21 within the anolyte compartment, i.e., where the body comes in contact with anolyte liquor.

Anodes 53 extend outwardly from the backplate 22. Cathodes 81 extend outwardly from the opposite side of the bipolar unit 21.

The cathode unit 71 of the bipolar unit 21 includes a plurality of individual cathode elements 81, a synthetic separator 101 outside of the cathode element 81, and a back screen 73 spaced from the backplate 22 and substantially parallel to the backplate 22. The back screen 73 and backplate 22 define a volume therebetween, i.e., a volume for the containment of catholyte liquor. The back screen 73 can be constructed of the same material as the cathodic surface 91 or the same material as the hollow finger 83 or of a permeable, rigid metal to allow synthetic separator 101 to function. Alternatively, the back screen 73 can be of a substantially impermeable material thereby preventing the flow of electrolyte or ions therethrough.

The individual cathode element 81 includes a hollow finger 83 that is substantially nonconductive. That is, it is fabricated of a reinforced or rigid or semi-rigid plastic or a ceramic or resin-coated metal whereby to avoid the presentation of an electrically active surface to the electrolyte. The hollow finger 83 has two side walls 84 which are substantially parallel to each other and porous to the flow of electrolyte therethrough. Side walls 84 may be porous, perforate, or foraminous and have from about 20 to about 80 percent open area. The hollow finger 83 serves to support the synthetic separator 101. The top 86, bottom 87, and leading edge 88 of the hollow finger 83 may be permeable to the flow of electrolyte and covered with a synthetic separator. Alternatively, the top 86, bottom 87, and leading edge 88 of the hollow finger 83 may be closed. One advantage of the hollow finger 83 herein contemplated is that the top 86, the bottom 87, and the leading edge 88 may be open to allow the synthetic separator 101 to function in such regions. This is because the hollow finger 83 does not have an electrocatalytic material thereon and can withstand the conditions encountered in sealing joints between segments of the synthetic separator.

An electrolyte tight seal is provided between the hollow finger 83 and the back screen 73 while allowing the volume within the hollow finger 83 and between the back screen 73 and the backplate 22 to be in contact with each other through openings 90, defining a catholyte volume, as described above.

The synthetic separator 101 on the outer surface of the hollow finger 83 may, as described above, also be on the outer surface of the back screen 73. The synthetic separator 101 may be a separate sheet or film of the synthetic separator material on the back screen in order to allow individual installation and removal of the cathode elements 81 from the cathode unit 71.

The cathodic electrode 91 is inside the hollow finger 83 and has a conductive base 93 and an electrical conduction means 95.

The cathodic electrode 91 corresponds to conductive means 97 in the backplate 22 so as to provide, in a preferred exemplification, individually removable cathode elements 81. The conductive means 95 and 97 can be spring copper 95 corresponding to spring copper 97 extending outwardly from a conductor 99 that passes through the backplate 22.

The cathodic electrode 91 is not limited as to form or structure as in the electrolytic diaphragm cells of the prior art. It may be a plate, sheet, wall, or screen that is substantially parallel to the walls of the hollow finger 81. The cathodic electrode 91 may have one wall or two parallel walls. Alternatively, the cathodic electrode 91 may be an electrically conductive porous body either with catalyst or without catalyst. Additionally, the cathodic electrode 91 may have means to feed air to the active surface thereof.

The cathodic unit 71 may be one side of a bipolar unit 21. Alternatively, the cathodic unit 71 may be one surface of a monopolar cell.

While the invention has been described with respect to certain exemplifications and embodiments thereof, the invention is not to be limited except as in the claims appended hereto.

We claim:

1. A cathode unit comprising:

(a) a cathode element containing:

(1) a hollow, substantially non-conductive finger having two substantially parallel, perforate side walls, a top, a bottom, a leading edge, and an open trailing edge;

(2) a synthetic separator on the outer surface of the hollow finger; and (3) a cathodic electrode inside said finger, said cathodic electrode having a base and electrical conduction means at the base thereof;

(b) a backplate in electrical contact with the cathodic electrode through said electrical conduction means; and (c) a backscreen spaced from and substantially parallel to said backplate, and interposed between said hollow finger and said backplate the open trailing edge of said hollow finger bearing upon said backscreen, and said hollow finger and said back screen having an electrolyte tight seal therebetween whereby to define a volume within said hollow finger and between said back screen and said backplate.

2. The cathode unit of claim 1 wherein said cathodic electrode is spaced from and substantially parallel to the side walls of said hollow finger.

3. The cathode element of claim 1 wherein said cathodic electrode comprises a single electrically conductive sheet.

4. The cathode element of claim 1 wherein said cathodic element comprises a pair of electrically conductive sheets parallel to and spaced from one another.

5. The cathode element of claim 1 wherein said cathodic electrode comprises an electrically conductive porous body.

6. A cathode unit comprising:

(a) a plurality of individual cathode elements, each cathode element containing:

(1) a hollow, substantially non-conductive finger having two substantially parallel, perforate side walls, a top, a bottom, a leading edge, and an open trailing edge;

(2) a synthetic permionic membrane on the outer surface of the hollow finger; and (3) a cathodic electrode inside said finger, said cathodic electrode having a base and electrical conduction means at the base thereof;

(b) a backplate in electrical contact with each of the cathodic electrodes through said electrical conduction means; and (c) a backscreen spaced from and substantially parallel to said backplate and interposed between said hollow fingers and said backplate, said hollow fingers and cathodic electrodes being substantially parallel to each other and extending substantially perpendicularly outward from said back screen, the open trailing edges of said hollow fingers bearing upon said back screen, said hollow fingers and said back screen having electrolyte tight seals therebetween whereby to define a volume within said hollow fingers and beween said back screen and said backplate.

7. The cathode unit of claim 6 wherein the cathodic electrode within a hollow finger is spaced from and substantially parallel to the said walls of the hollow finger.

8. The cathode element of claim 6 wherein each cathodic electrode comprises a single electrically conductive sheet.

9. The cathode element of claim 6 wherein a cathodic electrode comprises an electrically conductive porous body.

10. The cathode element of claim 9 comprising means for feeding oxygen to said electrically conductive, porous electrode.

11. A cathode element comprising:

a hollow, substantially non-conductive finger having two substantially parallel, perforate side walls, a top, a bottom, and a leading edge;

a permionic membrane on the outer surface of the finger; and a cathodic electrode comprising a single, electrically conductive sheet inside said hollow finger.

12. A cathode element comprising:

a hollow, substantially non-conductive finger having two subsubstantially parallel, perforate side walls, a top, a bottom, and a leading edge;

a permionic membrane on the outer surface of the finger; and a cathodic electrode comprising a pair of electrically conductive sheets parallel to and spaced from one another inside said hollow finger.

13. A cathode element comprising:

a hollow, substantially non-conductive finger having two subtantially parallel, perforate side walls, a top, a bottom, and a leading edge;

a permionic membrane on the outer surface of the finger;

a cathodic electrode comprising an electrically conductive porous body inside said hollow finger; and means for feeding air to said porous cathodic electrode.

* * * * *